United States Patent [19]

Taylor et al.

[11] Patent Number: 4,741,856

[45] Date of Patent: May 3, 1988

[54] PACKAGED PERFUMED GRANULAR DETERGENT

[75] Inventors: Edmund H. Taylor, Covington, Ky.; Charles A. Schulz, Fairfield, Ohio

[73] Assignee: The Procter & Gamble Company, Cincinnati, Ohio

[21] Appl. No.: 875,900

[22] Filed: Jun. 18, 1986

Related U.S. Application Data

[63] Continuation-in-part of Ser. No. 869,753, Jun. 2, 1986, abandoned.

[51] Int. Cl.[4] ..... C11D 17/04

[52] U.S. Cl. ..... 252/174; 252/90; 252/92; 252/95; 252/99; 252/135; 252/174.11; 252/186.1; 252/186.2; 220/260; 118/214; 206/0.5

[58] Field of Search ..... 252/92, 90, 93, 95, 252/174, 99, 135, 140, 174.11, 186.1, 186.2; 220/260; 229/17 R; 118/214; 206/0.5

[56] References Cited

U.S. PATENT DOCUMENTS

| | | | |
|---|---|---|---|
| 126,272 | 4/1872 | Davis | 221/11 |
| 2,098,763 | 11/1937 | Sebell | 221/11 |
| 2,124,722 | 7/1938 | Walter | 91/51 |
| 2,350,312 | 5/1944 | Hatch | 229/5.5 |
| 2,365,775 | 12/1944 | Punte | 91/49 |
| 2,368,261 | 5/1953 | Poole | 229/5.5 |
| 2,388,911 | 11/1945 | Fink | 91/50 |
| 2,447,528 | 8/1948 | Paynter | 94/4.9 |
| 2,974,824 | 3/1961 | Mansho | 220/53 |
| 3,029,009 | 4/1962 | Hill | 229/17 |
| 3,424,338 | 1/1969 | Kazel | 220/54 |
| 3,424,343 | 7/1965 | Hoeffelman | 220/67 |
| 3,988,432 | 10/1976 | Steltenkamp | 252/89 R |
| 4,059,220 | 11/1977 | Lorenz | 229/37 R |
| 4,164,303 | 8/1979 | Waterbury | 220/359 |
| 4,232,797 | 11/1980 | Waterbury | 220/359 |
| 4,239,639 | 12/1980 | Gilbert et al. | 252/99 |
| 4,241,864 | 12/1980 | Kessler | 229/43 |
| 4,380,447 | 4/1983 | VanderLugt, Jr. | 493/102 |
| 4,413,587 | 11/1983 | Cook | 118/210 |
| 4,577,769 | 3/1986 | Delia | 220/260 |

OTHER PUBLICATIONS

U.S. patent application Ser. No. 848,676 filed Apr. 4, 1986, Carr and Rembold.

*Primary Examiner*—Paul Lieberman
*Assistant Examiner*—Hoa Van Le
*Attorney, Agent, or Firm*—Robert B. Aylor; Donald E. Hasse; Thomas H. O'Flaherty

[57] ABSTRACT

Perfumed granular detergent compositions are packaged in a fiberboard package comprising a plastic end piece.

26 Claims, No Drawings

PACKAGED PERFUMED GRANULAR DETERGENT

This is a continuation-in-part of our copending application, Ser. No. 869,753, filed June 2, 1986, for PACKAGED PERFUMED GRANULAR DETERGENT now abandoned.

TECHNICAL FIELD AND BACKGROUND ART

The invention relates to the packaging of perfumed granular detergent compositions, especially those of the type useful in laundry applications. The packaged perfumed detergent composition of this invention have superior perfume odor characteristics, especially at the initial opening of the package, and better pouring/dispensing chacteristics.

Packaging for detergent compositions is typically a compromise between protection and the need to limit the expense of the package. The typical package for a granular detergent composition is made from fiberboard which is cut into a single blank and then folded and glued to form the package. Where additional protection is needed it is usually provided by means of a thin layer of an impermeable material which provides a barrier while the major structural strength is provided by the fiberboard.

SUMMARY OF THE INVENTION

The present invention comprises the combination of a perfumed granular detergent composition in a package comprising a conventional fiber board tube produced from a blank, and having a plastic container lid attached to the top end of the said tube to seal the top edge of the tube.

It has been found that perfumed granular detergent compositions normally do not have the intended odor when packaged in conventional fiberboard packages. I.e., when the consumer tears open the fiberboard and dispenses the detergent composition, the overall effect of the odor is not as intended. Some combination of events involving the trapping of fiberboard odor in the head space over the detergent composition, a creation of an "off" odor by tearing the fiberboard, and/or the loss of certain perfume notes to the fiberboard create an off odor. The effect of this loss in odor quality on consumer acceptance has not been heretofore understood.

The initial odor which the consumer detects when opening a package containing a perfumed granular detergent composition can be improved by providing a plastic top closure for conventional fiberboard packages. The plastic closure preferably comprises a means for providing an opening through the plastic as opposed to providing the opening through the fiberboard.

DETAILED DESCRIPTION OF THE INVENTION

The Package

The packages of this invention have a type of structure which has been suggested for other uses. The general structure of such composite packages is disclosed, for example, in U.S. Pat. No. 126,272—Davis, issued Apr. 30, 1872; U.S. Pat. No. 3,424,343—Hoeffelman, issued Jan. 28, 1969; U.S. Pat. No. 4,241,864—Kessler, issued Dec. 30, 1980; and U.S. Pat. No. 4,380,447—VanderLugt, Jr., issued Apr. 19, 1983, all of the above patents being incorporated herein by reference.

Preferably the bottom and the sides of the package are formed in the same manner as a conventional sealed end granular detergent package.

The plastic container lid, or end piece, can be applied to the open end of the package using an adhesive and/or compression means as taught, for example, in U.S. Pat. No. 2,447,528—Paynter, issued Aug. 24, 1948; U.S. Pat. No. 2,365,775—Punte, issued Dec. 26, 1944; U.S. Pat. No. 2,124,722—Walter, issued July 26, 1938; U.S. Pat. No. 2,388,911—Fink, issued Nov. 13, 1945; and/or U.S. Pat. No. 4,413,587—Cook, issued Nov. 8, 1983 and in the previously mentioned patents. All of the patents mentioned hereinbefore are incorporated herein by reference.

A preferred application means for applying adhesive to the open end of substantially rectangular tubes comprises a conveying means with guide rails to support the tubes upright (i.e., with their open end facing upwardly) in a substantially immovable manner. The conveying means moves the vertically disposed tubes through an adhesive application area at a constant speed. Two or more rotary adhesive rolls are disposed at an angle of about 15° from the center line of the conveyor (and the line of movement). The rotational speed of the applicators is preferably somewhat slower than the corresponding speed of the tubes on the conveying means such that when the rotary adhesive applicators contact the upper edges of the open end of such moving containers, adhesive is applied to the distal edges and upper portions of such open container end. By modifying the applicator roll speed and/or angle, the location and/or amount of adhesive on the ends of the tube can be controlled. The plastic container lid is then applied. If desired the adhesive can be applied by hand, but automatic application is preferred.

The container lids, or end pieces, of the invention are preferably made by conventional plastic forming (e.g. thermoforming or injection molding) techniques out of low odor thermoplastic materials such as, polystyrene, polyethylene, polypropylene, polyvinyl chloride, polyester and the like. Impact modified polystyrene is preferred. Suitable adhesives are well known in the art and include those specifically exemplified in U.S. Pat. No. 3,424,343, especially in Table 1, appearing in the middle of Column 4.

The plastic container lid is preferably formed with a dispensing opening that has an easily removable closure, especially one that can be readily opened and reclosed as desired. Preferred closures for the dispensing opening are attached by tethers to the container lid structure or the package itself. The opening is preferably flush with the container lid surface. Examples of reclosable and/or easily opened closures for openings are described in U.S. Pat. No. 2,098,763, Sebell, issued Nov. 9, 1937 (preferred); U.S. Pat. No. 3,424,338, Kazel issued Jan. 28, 1969; U.S. Pat. No. 4,164,303, Waterbury, issued Aug. 14, 1979; U.S. Pat. No. 4,232,797, Waterbury, issued Nov. 11, 1980; and U.S. Pat. No. 3,029,009, Hill, issued Apr. 10, 1962 and German Auslegeschrift No. 2,407,345, Muller et al, published Sept. 5, 1974, all of which are incorporated herein by reference. An ovate opening with its tapered end in the direction of desired pouring is particularly preferred.

The use of the plastic container lid minimizes the amount of fiberboard that is in contact with the head space above the detergent composition and particularly eliminates the cut edges of the fiberboard that are in contact with the head space. It, therefore, minimizes the major sources of leakage of gasses and vapors in and out of the package. By providing a dispensing opening in the plastic container lid it also eliminates the exposure of fresh fiberboard edges when the package is opened. Surprisingly elimination of the edges of fiberboard in contact with the headspace, provides a distinct odor advantage. Since formation of the container lid and formation of the package can be more difficult and expensive than forming a conventional package, there is generally little incentive to provide a plastic container lid, absent this surprising advantage.

In addition to the perfume advantage, however, the plastic container lid also provides for better pouring/-dispensing of granular detergent compositions, especially those which often tend to dispense poorly. It is believed that the improved pouring/dispensing is the result of improved protection of the detergent compositions from moisture, $CO_2$, etc. The plastic container lid also provides improved protection at the top, thus allowing the use of lower barrier fiberboard in the remainder of the package than would otherwise be acceptable. The package especially protects sensitive detergent components that are not stable in the presence of, for example, moisture vapor, carbon dioxide, oxygen, etc. Such sensitive ingredients are well known to those skilled in the detergent arts and include silicates which are insolubilized by $CO_2$ and bleach ingredients which are destabilized by moisture.

A plastic bottom lid, or end piece, can also be used.

For any given detergent composition requiring a particular level of protection, the fiberboard required can have a lower barrier rating. If the plastic container lid only is used, the barrier level can be lowered at least about 10% in the Water Vapor Transmission Rate Test (WVTR) described hereinafter.

If both a plastic container lid and a plastic bottom lid, or end piece, are used the barrier level can be lowered at least about 20%. Thus, a two piece carbon (plastic container lid only) fabricated with a fiberboard having a WTVR of no more than about 5, preferably no more than about 3, can be used with most detergent compositions. A three piece carbon (plastic container lid and end piece) fabricated with a fiberboard having a barrier level of no more than about 7, preferably no more than about 5, can be used with the same detergent compositions. Preferably, more expensive corrugated fiberboard and increased barrier overwraps are not used.

In addition to perfume, other air-sensitive materials also are protected by the cartons described herein. Such materials as bleaches, bleach activators, enzymes, alkali metal silicates (1:1 to 3.6:1 ratio), etc. are preferably protected from moisture, $CO_2$, etc. Specific materials that need protection include sodium perborate (mono- and tetrahydrates), sodium percarbonate, sodium silicates having $SiO_2$:$Na_2O$ ratios of from about 1:1 to about 3.6:1, organic peracids e.g. tetraacetyl ethylenediamine, diperoxydodecanedioic acid, monononyl amide of monoperoxysuccinic acid, sodium dichloroisocyanurate (dihydrate), $C_{8-10}$ acyloxybenzene sulfonates e.g. octanoyl or nonanoyl acyl-oxybenzene sulfonates (sodium or potassium), bleach activator compounds having the formula:

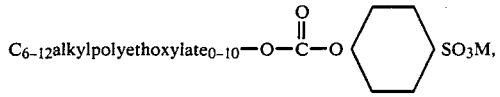

proteases (e.g., Alcalase), etc.

The Detergent Composition

The detergent compositions of this invention are those conventional detergent compositions known to the art, especially those containing lower levels of perfume. If a very high level of a perfume with large amounts of relatively volatile top notes is used, the perfume in the head space can overwhelm any off odors that are produced. However, if the perfume is present at a low level, and especially if the perfume composition contains relatively low percentages of highly volatile top notes, the package described hereinbefore will provide a very large advantage over a conventional package.

Examples of detergent compositions can be found in U.S. patents: U.S. Pat. No. 4,539,130—Thompson et al, issued Sept. 3, 1985; U.S. Pat. No. 4,490,271—Spadini et al, issued Dec. 25, 1984; U.S. Pat. No. 4,412,934—Chung et al, issued Nov. 1, 1983; U.S. Pat. No. 4,399,049—Gray et al, issued Aug. 16, 1983; U.S. Pat. No. 4,379,080—Murphy, issued Apr. 5, 1983; U.S. Pat. No. 4,228,025—Jacobsen, issued Oct. 14, 1980; and U.S. Pat. No. 4,217,105—Goodman, issued Aug. 12, 1980, all of said patents being incorporated herein by reference.

Detergent compositions of the present invention can include any ingredients known for use in such compositions. For example, they preferably contain from about 1% to about 75%, preferably from about 10% to about 50%, more preferably from about 15% to about 40%, by weight of a detergent surfactant. The surfactant can be selected from the various nonionic, anionic, cationic, zwitterionic and/or amphoteric surfactants, such as those described in U.S. Pat. No. 4,318,818, Letton et al, issued Mar. 9, 1982, incorporated herein by reference.

Preferred anionic surfactants are $C_{10}$–$C_{18}$ (preferably $C_{12}$–$C_{16}$) alkyl sulfates containing an average of from 0 to about 4 ethylene oxide units per mole of alkyl sulfate, $C_9$–$C_{15}$ (preferably $C_{11}$–$C_{13}$) alkylbenzene sulfonates, $C_{12}$–$C_{18}$ paraffin sulfonates, $C_{12}$–$C_{18}$ alkyl glyceryl ether sulfonates and esters of alpha-sulfonated $C_{12}$–$C_{18}$ fatty acids.

Preferred nonionic surfactants are ethoxylated alcohols of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophile balance) of from about 10 to about 13. Particularly preferred are condensation products of $C_{12}$–$C_{15}$ alcohols with from about 3 to about 7 moles of ethylene oxide per mole of alcohol, e.g., $C_{12}$–$C_{13}$ alcohol condensed with about 6.5 moles of ethylene oxide per mole of alcohol.

Other suitable optional ingredients are disclosed in the patents incorporated herein by reference.

Examples of perfume components that are conventionally used in detergent compositions, and which are sensitive to off odors are disclosed in U.S. Pat. No. 4,515,705—Moeddel, issued May 7, 1985, and incorporated herein by reference.

The compositions contain from about 0.001% to about 2%, preferably from about 0.01% to about 1%, more preferably from about 0.1% to about 0.5%, by weight of a perfume selected from the group consisting of phenyl ethyl alcohol, linalool, geraniol, citronellol, cinnamic alcohol, isobornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxycitronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethylindan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, ortho-tertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetene, phenyl ethyl acetate, oakmoss (e.g., 25%), hexyl salicylate, eucalyptol, and mixtures thereof. Preferably, the above materials are at least about 40%, preferably at least about 60% of the perfume.

Preferred perfume materials are those that provide the largest odor improvements in finished product compositions packaged in the detergent package of this invention. These perfumes include phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxycitronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethylindan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso eugenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss (e.g., 25%), and mixtures thereof.

Particularly preferred of the above group are phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxycitronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

The perfume is present in the detergent composition at a level of from about 0.01% to about 2%, preferably from about 0.05% to about 1%, most preferably from about 0.1% to about 0.5%.

All parts, ratios and percentages herein are by weight unless otherwise specified. The following demonstrates the advantages of the invention.

EXAMPLE I

A perfumed granular detergent composition containing 0.15% of a conventional perfume was placed in a conventional fiberboard carton and in a carton formed by gluing a channeled impact modified polystyrene plastic top lid with an opening in the plastic to a bottom formed from fiberboard (2-piece carton). The cartons were opened and the odor graded by an expert perfumer, using an odor grade in which 10 is perfect and 6 is unacceptable. A grade difference of 1 is significant. In three separate tests the 2-piece carton gave odor grades of 9, 9, and 8 and the standard carton gave odor grades of 8, 8, and 7.

Cartons of product stored for varying lengths of time were opened and graded as above. The odor grades were as follows:

| Perfumed Product Packed for | Standard Carton | 2-Piece Carton |
|---|---|---|
| | (graded in freshly opened carton) | |
| 0 days | 8.0 | 9.0 |
| | (poured from carton and graded in cups) | |
| 1 day | 8.5 | 8.5 |
| 2 wks | 8.25 | 8.5 |
| 5 wks | 7.75 | 8.25 |
| 8 wks | 7.0 | 8.0 |

As can be seen from the above data, the longer the cartons are stored, the larger the difference in odor grades.

In subsequent consumer tests, the 2-piece carton was always at least directionally preferred.

EXAMPLE II

Detergent compositions in the 2-piece cartons of Example I and the same type of cartons with a plastic end piece replacing the bottom of the carton (3-piece carton) were tested in the Water Vapor Transmission Rate Test (WVTR).

The Water Vapor Transmission Rate test measures water vapor pickup by silica gel (Davison Chemical, Grade 43, Code No. 43-08-05-215, mesh size 14–20, cu. 85) in a carton sealed in the normal way with hot melt adhesive (e.g., Bostitch 22219). Three undamaged filled cartons are stored in a 73° F./50% relative humidity (RH) room for one day. These ($8\frac{1}{8} \times 10\frac{7}{8} \times 2\frac{3}{8}$") cartons are filled with 500 gms silica gel and the cartons are then sealed. The filled cartons are placed in an 80° F./80%RH room for six hours, weighed, stored for a period (16 hours is the standard for lower barrier cartons—longer times are used with high barrier cartons) and reweighed to 0.1 g and the rate calculated for g $H_2O$/24 hours. The amount of silica gel is adjusted so that the maximum water pickup is no more than 2% of the weight of the silica gel. The gel should be dry and can be dessicated at between 200° and 500° F. Variations from the above limits should be minimized.

The numbers given are in grams of water which pass each 24 hours into the carton on the average. A significant difference is about a 10% reduction. The results were as follows:

| WATER WEIGHT GAIN (Gms $H_2O$/24 hrs. in equal-size cartons) | | | |
|---|---|---|---|
| Carton Board Barrier Level | Construction | Avg. of 2 Row | % Reduction from Standard |
| Low | Standard | 7.2 | |
| | 2-piece | 5.9 | 18 |
| | 3-piece | 3.4 | 53 |
| Low-Med. | Standard | 4.5 | |
| | 2-piece | 3.4 | 24 |
| | 3-peice | 1.8 | 60 |
| Med.-High | Standard | 2.6 | |
| | 2-piece | 2.0 | 23 |
| | 3-piece | 1.3 | 50 |
| High | Standard | .85 | |
| | 2-piece | .80 | 6 |
| | 3-piece | .65 | 24 |

As can be seen from the above, replacement of the tops and/or bottoms with plastic end pieces allows a considerable reduction in the barrier properties of the sides for the same level of protection.

What is claimed is:

1. A granular detergent composition comprising a material selected from the group consisting of perfumes, air-sensitive ingredients and mixtures thereof in a package comprising a conventional fiberboard tube produced from a blank, said fiberboard tube having an open upper end and said package further comprising a separate plastic end piece which is attached so as to seal said open upper end of the upper edge of the tube.

2. The composition of claim 1 wherein the plastic end piece additionally includes a dispensing opening and a closure for said opening which can be unsealed to dispense the detergent composition.

3. The composition of claim 2 wherein the plastic is selected from the group consisting of polystyrene, polyethylene, polypropylene, polyvinyl chloride, polyester and mixtures thereof.

4. The composition of claim 3 wherein the perfume comprises a material selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxycitronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, ortho-tertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetene, phenyl ethyl acetate, oakmoss, hexyl salicylate, eucalyptol, and mixtures thereof.

5. The composition of claim 4 wherein the perfume comprises a material selected from the group consisting of phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxycitronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso eugenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss, and mixtures thereof.

6. The composition of claim 5 wherein the perfume comprises a material selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

7. The composition of claim 2 wherein the seal for the opening in the plastic end piece is easily reclosable.

8. The composition of claim 7 wherein said seal is attached by a tether to the plastic closure.

9. The composition of claim 8 wherein said plastic is impact modified polystyrene.

10. The composition of claim 2 wherein said plastic is impact modified polystyrene.

11. The composition of claim 1 wherein said fiberboard tube also has an open bottom end and said package further comprises a separate plastic bottom lid which is attached so as to seal said open bottom end of the bottom edge of said tube.

12. The composition of claim 11 wherein the plastic end piece additionally includes a dispensing opening and a closure for said opening which can be unsealed to dispense the detergent composition.

13. The composition of claim 12 wherein the plastic is selected from the group consisting of polystyrene, polyethylene, polypropylene, polyvinyl chloride, polyester and mixtures thereof.

14. The composition of claim 13 wherein the perfume comprises a material selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxycitronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, ortho-tertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetene, phenyl ethyl acetate, oakmoss, hexyl salicylate, eucalyptol, and mixtures thereof.

15. The composition of claim 14 wherein the perfume comprises a material selected from the group consisting of phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxycitronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso eugenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss, and mixtures thereof.

16. The composition of claim 15 wherein the perfume comprises a material selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

17. The composition of claim 11 wherein the material is an air-sensitive material.

18. The composition of claim 17 wherein said air-sensitive material is selected from the group consisting of alkali metal silicate, bleach ingredients and mixtures thereof.

19. The granular detergent composition of claim 1 comprising a perfume.

20. The composition of claim 19 wherein the plastic is a thermoplastic material selected from the group consisting of polystyrene, polyethylene, polypropylene, polyvinyl chloride, polyester and mixtures thereof.

21. The composition of claim 20 wherein the perfume comprises a material selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxycitronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, ortho-tertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetene, phenyl ethyl acetate, oakmoss, hexyl salicylate, eucalyptol, and mixtures thereof.

22. The composition of claim 21 wherein the perfume comprises a material selected from the group consisting of phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxycitronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso eugenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss, and mixtures thereof.

23. The composition of claim 22 wherein the perfume comprises a material selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

24. The composition of claim 19 wherein the perfume comprises a material selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxycitronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, ortho-tertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetene, phenyl ethyl acetate, oakmoss, hexyl salicylate, eucalyptol, and mixtures thereof.

25. The composition of claim 24 wherein the perfume comprises a material selected from the group consisting of phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-isopropyl alpha-octyl hydrocinnamic aldehyde, hexyl cinnamic aldehyde, hydroxycitronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso eugenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss, and mixtures thereof.

26. The composition of claim 25 wherein the perfume comprises a material selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

* * * * *